United States Patent [19]

Goren

[11] 4,007,981

[45] Feb. 15, 1977

[54] DUAL MODE ELECTROSTATOGRAPHIC PRINTING MACHINE

[75] Inventor: Robert N. Goren, Rochester, N.Y.

[73] Assignee: Xerox Corporation, Stamford, Conn.

[22] Filed: Apr. 10, 1975

[21] Appl. No.: 566,873

[52] U.S. Cl. ..... 355/4; 355/8

[51] Int. Cl.[2] ..... G03G 15/30

[58] Field of Search ..... 355/3 R, 4, 8, 11, 17, 355/67; 96/1.2, 45

[56] References Cited

UNITED STATES PATENTS

| | | | |
|---|---|---|---|
| 3,120,790 | 2/1964 | Carlson et al. | 355/3 R |
| 3,313,623 | 4/1967 | Bixby | 355/4 X |
| 3,517,596 | 6/1970 | Johnson et al. | 355/4 X |
| 3,580,671 | 5/1971 | Lavander | 355/71 X |
| 3,775,006 | 11/1973 | Hartman et al. | 355/4 |

*Primary Examiner*—L. T. Hix
*Assistant Examiner*—Kenneth C. Hutchison
*Attorney, Agent, or Firm*—J. J. Ralabate; C. A. Green; H. Fleischer

[57] ABSTRACT

A dual mode color electrostatographic printing machine in which either a pictorial copy or a functional copy of an original document is reproduced. Either mode of operation is selectable. In the pictorial copying mode, the latent image recorded on the photoconductive surface is modulated by a line screen pattern. Contrariwise, in the functional copying mode, the latent image remains un-modulated. The screen is shifted by one-third of the spacing between the lines in the screen for each successive color separation exposure.

11 Claims, 4 Drawing Figures

DUAL MODE ELECTROSTATOGRAPHIC PRINTING MACHINE

BACKGROUND OF THE INVENTION

This invention relates generally to an electrostatographic printing machine, and more particularly concerns a printing machine adapted to operate either in a pictorial or functional copying mode.

In a typical electrostatographic printing machine, a latent image is recorded on a surface and developed with charged particles. A sheet of support material is positioned closely adjacent to the latent image and arranged to have the particles transferred thereto. After the particles are transferred to the sheet of support material, they are permanently affixed thereto forming a copy of the original document. Electrophotographic printing and electrographic printing are different versions of electrostatographic printing. In the process of electrophotographic printing, a photoconductive member is charged to a substantially uniform level. The light image of an original document irradiates the charged photoconductive member dissipating the charge in accordance with the intensity thereof. This records an electrostatic latent image on the photoconductive member corresponding to the original document being reproduced. Electrographic printing differs from electrophotographic printing in that neither a photoconductive member nor a light image is required to create a latent image of the original document. Generally, both of the foregoing processes employ heat settable particles to develop the latent image. Heat is applied to these particles permanently affixing them to the sheet of support material.

A multi-color electrophotographic printing machine is essentially the same as a black and white printing machine. However, in multi-color printing, the foregoing process is repeated a plurality of cycles, each cycle being for a discrete color. In this process, the light image is filtered to record an electrostatic latent image on the photoconductive member corresponding to a single color. A plurality of different single color light images are formed. Each single color electrostatic latent image is developed with toner particles complementary in color to the color of the filtered light image. The toner powder images are then transferred to the sheet of support material in superimposed registration with one another. The multi-layered toner powder image is then permanently affixed by the application of heat thereto to the sheet of support material producing a permanently colored copy of the original document.

Heretofore, an electrophotographic printing machine was merely adapted to produce either a functional copy or a pictorial copy. A functional copy is a copy of a document wherein subtle variations of tone or color are not present, such as in a graph, chart, lines, etc. Functional copying machines have great difficulty in forming tone gradations. Contrawise, a pictorial copying machine employs a half-tone screen to overcome this defect. The screen produces tonal gradations by forming half-tone dots or lines of varying size. In the highlight regions, the half-tone pattern may comprise narrow lines or small dots. The lines increase in width or the dots in size throughout the intermediate shades until they merge together at the shadow end. In this manner, there will be complete whiteness at the highlight end and nearly solid black at the shadow end of the tone scale.

Numerous patents teach the concept of screening. Exemplary of these patents are U.S. Pat. Nos. 2,598,732; 3,535,036; 3,121,010; 3,493,381; 3,776,633; and 3,809,555. A recent Japanese application shows the utilization of an auxiliary light source in conjunction with a screen in the optical light path. This is Japanese application No. 47-124,202 dated Dec. 11, 1972 having a laid open Japanese application No. 49-82345, the inventor being Masayasu Anzai and the applicant being Hitachi, Ltd. Other copending applications relevant thereto are Ser. No. 511,976, filed Oct. 4, 1974, and now U.S. Pat. No. 3,936,173, and Ser. No. 507,169, filed Sept. 18, 1974.

However, none of the prior art references appear to disclose an electrophotographic printing machine having the capability of operating in either the functional or pictorial copying mode. Nor do the prior art references appear to teach electrophotographic printing machines having the ability to vary the reproduction contrast of copies by adjusting the half-tone screen. Thus, no printing machine hereinbefore developed had the capability of de-energizing the screen selectively so as to change from the pictorial mode to the functional mode.

Accordingly, it is a primary object of the present invention to improve an electrostatographic printing machines by providing simple contrast adjustments as well as pictorial and functional copying modes.

BRIEF SUMMARY OF THE INVENTION

Briefly stated, and in accordance with the present invention, there is provided an electrostatographic printing machine for reproducing an original document.

Pursuant to the features of the present invention, means are provided for forming a functional copy of the original document. In addition, means are provided for forming a pictorial copy of the original document. Means actuate selectively the pictorial copy forming means or the functional copy forming means.

BRIEF DESCRIPTION OF THE DRAWINGS

Other objects and advantages of the present invention will become apparent upon reading the following detailed description and upon reference to the drawings, in which.

While the present invention will be described in connection with the preferred embodiments thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
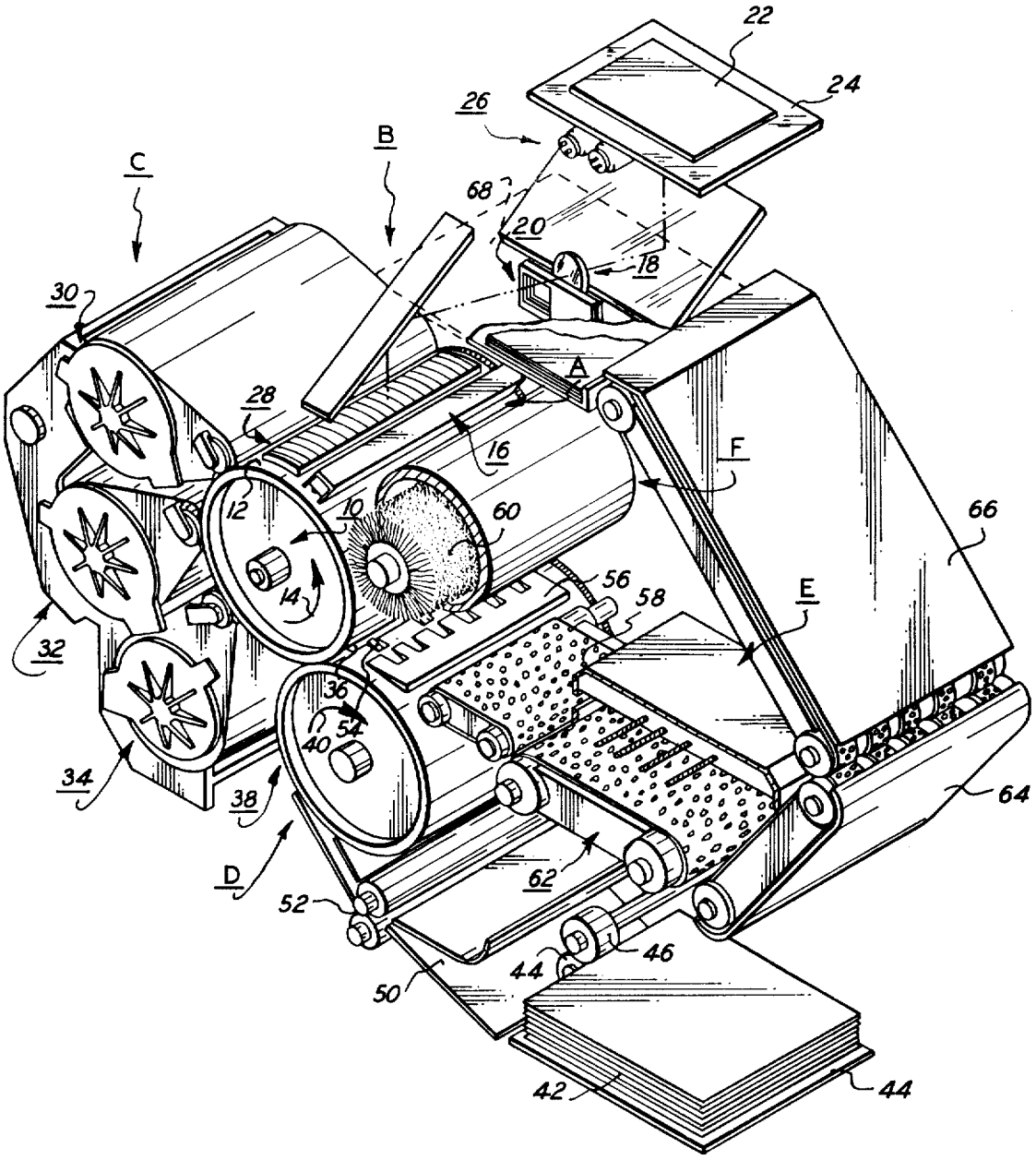
FIG. 1 is a schematic, perspective view of an electrophotographic printing machine incorporating the features of the present invention therein.

A general understanding of an electrophotographic printing machine having the features of the present invention incorporated therein may be had by referring to FIG. 1. In all of the drawings, like reference numerals have been used throughout to designate like elements. The electrophotographic printing machine shown in FIG. 1 is arranged to produce functional or pictorial copies from a colored original document. The original document may be in the form of single sheets, books, three-dimensional objects, or colored slides. Preferably, the type of copy that is desired would depend upon the original document being reproduced. For example, bar charts, graphs, etc. would be reproduced as functional copies whereas photographs would be reproduced in the pictorial copy mode.

As shown in FIG. 1, the electrophotographic printing machine includes a photoconductive member having a rotatable drum 10 with a photoconductive surface 12 entrained thereabout and secured thereto. Drum 10 is mounted on a shaft (not shown) and rotates in the direction of arrow 14. This moves photoconductive surface 12 sequentially through a series of processing stations. Preferably, photoconductive surface 12 is made from a suitable selenium alloy such as is described in U.S. Pat. No. 3,655,377 issued to Sechak in 1972. A timing disc (not shown) is mounted on one end of the shaft of drum 10. This timing disc cooperates with a light source and photosensor to produce an electrical signal which is coupled to the machine logic. In this way, as drum 10 rotates, the appropriate processing station is activated.

For purposes of the present disclosure, the various processing stations in the printing machine will be briefly described hereinafter.

As drum 10 rotates in the direction of arrow 14, it passes through charging station A. Charging station A includes a corona generating device, indicated generally by the reference numeral 16. Corona generating device 16 charges photoconductive surface 12 to a relatively high substantially uniform level. Preferably, corona generating device 16 extends in a generally transverse direction across photoconductive surface 12 to produce a spray of ions for the charging thereof. One type of suitable corona generating device is described in U.S. Pat. No. 2,778,946 issued to Mayo in 1957.

Thereafter, drum 10 rotates the charged portion of photoconductive surface 12 to exposure station B. At exposure station B, the charged area of photoconductive surface 12 is exposed to a color filtered light image of the original document. A moving lens system, generally designated by the reference numeral 18, and a color filter mechanism, shown generally at 20, are positioned at exposure station B. U.S. Pat. No. 3,062,108 issued to Mayo in 1952 describes a moving lens system suitable for use in electrophotographic printing. A color filter mechanism suitable for use in the FIG. 1 electrophotographic printing machine is described in U.S. Pat. No. 3,775,006 issued to Hartman et al. in 1973. Original document 22 is disposed upon transparent viewing platen 24. Lamp assembly 26 is positioned beneath transparent viewing platen 24, and, in conjunction with lens system 18 and filter 20, moves in a timed relationship with drum 10 to scan successive incremental areas of original document 22. Preferably, lens 18 is a six element split dagor type of lens having front and back compound components with a diaphragm located centrally therebetween. The front lens component has three lens elements including, in the following order; a first lens element of positive power, a second lens element of negative power cemented to the first lens element, and a third lens element of positive power disposed between the second lens element and diaphragm. Preferably, the first lens element has a double convex lens as the front component, a concave lens as the second component and a convex-concave lens as the third component. Lens 18 has a preferred speed ranging from about F/4.5 to about F/8.0. A suitable type of lens is described in U.S. Pat. No. 3,592,531 issued to McCrobie in 1971. In this manner, a flowing light image of original document 22 is produced. This is a single color light image. The single color flowing light image is transmitted through screen member 28. In one embodiment, screen member 28 is interposed into the optical light path. In an alternate embodiment, screen member 28 is located out of the optical light path. Both of these embodiments will be discussed hereinafter in greater detail with reference to FIGS. 2 and 3. Screen member 28 is an arcuate sheet having a plurality of opaque lines thereon. One skilled in the art will appreciate that while a curved screen member will be described, a flat screen may be employed in lieu thereof. The detailed structural configuration of screen member 28 will be discussed hereinafter with reference to FIG. 4. In operation, the flowing light image passing through screen member 28 is modulated so as to form a modulated single color light image which irradiates the charged portions of photoconductive surface 12. As hereinbefore noted, filter mechanism 20 interposes selected color filters into the optical light path. Successive color filters operate on the light rays passing through lens 18 to create a modulated single color light image which records a modulated single colored electrostatic latent image on photoconductive surface 12. The modulated single color latent image is that which is created by discharging the photoconductive member with a single color light image. Screen member 28 is operational only in the pictorial mode. Contrawise, if the printing machine is in the functional mode, screen member 28 is no longer operational. More particularly, when screen member 28 is in the optical path and the machine is switched from the pictorial mode to the functional mode, screen member 28 is removed from the optical path or spaced a sufficient distance from photoconductive surface 12 so as to be de-focused and ineffective.

After the electrostatic latent image is recorded on photoconductive surface 12, drum 10 rotates to development station C. Three developer units, generally indicated by the reference numerals 30, 32 and 34, are positioned at development station C. A suitable development station employing a plurality of developer units (in this case three) is described in U.S. Pat. No. 3,854,449 issued to Davidson in 1974. The developer units described therein are magnetic brush developer units. A typical magnetic brush development unit employs a magnetizable developer mix of carrier granules and toner particles. The developer unit forms a directional flux field to continually create a brush of developer mix. This developer mix brush is brought into contact with the modulated single color electrostatic latent image recorded on photoconductive surface 12. The toner particles adhering electrostatically to the carrier granules of the developer mix are attracted by the greater electrostatic force to the latent image and render it visible.

Developer units 30, 32 and 34, respectively, contain discretely colored toner particles. Each of the toner particles contained in the respective developer units correspond to the complement of the single color light images transmitted through three different color filters 20. For example, a modulated electrostatic latent image formed from a green filtered light image is rendered visible by depositing green absorbing magneta toner particles thereon using one of the developer units. Similarly, electrostatic latent images formed from blue and red light images are developed with yellow and cyan toner particles using the other developer units.

After the modulated electrostatic latent image recorded on photoconductive surface 12 is developed, drum 10 rotates to transfer station D. At transfer station D, the toner powder image adhering electrostatically on photoconductive surface 12 is transferred to a copy sheet or a sheet of support material 36. A biased transfer roll, shown generally at 38, recirculates support material 36. Transfer roll 38 is electrically biased to a potential of sufficient magnitude and polarity to electrostatically attract toner particles from photoconductive surface 12 thereto. In this manner, transfer roll 38 rotates in the direction of arrow 40, at substantially the same tangential velocity as drum 10. Thus, as transfer roll 38 rotates in synchronism with drum 10, successive toner powder images may be transferred from photoconductive surface 12 to sheet 38. A suitable electrically biased transfer roll is described in U.S. Pat. No. 3,612,677 issued to Langdon et al. in 1971.

Briefly describing the sheet feeding path, support material 36 is advanced from a stack 42 thereof disposed upon tray 44. Feed roll 46, in operative communication with retard roll 48, separates and advances the uppermost sheet from stack 42. The advancing sheet moves into chute 50 and is directed thereby into the nip of register rolls 52. Register rolls 52 align and forward the advancing sheet, in synchronism with the movement of transfer roll 38. Transfer roll 38 has gripper fingers 54 mounted therein. Gripper fingers 54 receive the advancing sheet 36 and secure it releasably to transfer roll 38. After the requisite number of toner powder images have been transferred to sheet 36, in superimposed registration with one another, sheet 36 is removed from transfer roll 38. The foregoing is achieved by having gripper fingers 54 space sheet 36 from transfer roll 38 as it rotates in the direction of arrow 40. This permits stripper bar 56 to be interposed therebetween separating sheet 36 from transfer roll 38. Sheet 36 passes over stripper bar 56 onto conveyor 58. Endless belt conveyor 58 moves support material 36 to fixing station E.

At fixing station E, a fuser, indicated generally by the reference numeral 60, permanently affixes the transferred toner powder images to support material 36. One type of suitable fuser is described in U.S. Pat. No. 3,826,892 issued to Draugelis in 1974. After the fixing process, sheet 36 is advanced by endless belt conveyors 62 and 64 to catch tray 66 for subsequent removal therefrom by the machine operator.

Invariably, following the transfer process, residual toner particles adhere to photoconductive surface 12. Cleaning station F, the final processing station in the direction of rotation of drum 10, as indicated by arrow 14, removes these residual toner particles. A pre-clean corona generating device (not shown) neutralizes the charge on photoconductive surface 12 and that of the residual toner particles. This enables fibrous brush 68, in contact with photoconductive surface 12, to remove the residual toner particles therefrom. A suitable brush cleaning system is described in U.S. Pat. No. 3,590,412 issued to Gerbasi in 1971.

It is believed that the foregoing description is sufficient for purposes of the present application to describe the features of the electrophotographic printing machine in which the present invention is incorporated.

Figure 2:
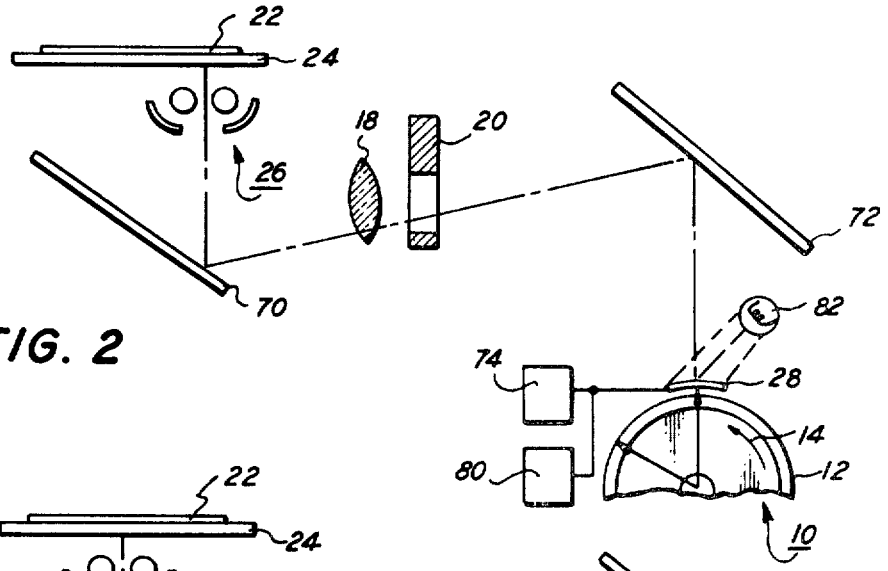
FIG. 2 is an elevational view of one embodiment of the exposure system employed in the FIG. 1 electrophotographic printing machine.

Referring now to FIG. 2, there is shown one embodiment of exposure station B. As shown thereat, lamps 26 moves across platen 24 with original document 22 disposed face down thereon. The light rays reflected from original document 22 pass through transparent platen 24 onto mirror 70. Mirror 70 reflects the light rays through lens 18 which forms a flowing light image thereof. The flowing light image is then transmitted through the appropriate filter of filter mechanism 20 so as to produce a single color flowing light image. This single color flowing light is reflected by mirror 72 through screen member 28 forming a modulated single color flowing light image. The modulated single color light image thereupon irradiates the charged portion of photoconductive surface 12. This selectively discharges photoconductive surface 12 to record thereon a modulated single color electrostatic latent image. Light source or lamp 82 provides additional non-image illumination. The light rays from lamp 82 pass through screen member 28 in superimposed registration with the light image. This reduces the illumination power level required from lamps 26 and flattens contrast.

The foregoing is the manner of operation when the printing machine is in the pictorial mode. In this mode of operation, contrast may be adjusted by moving the screen member 28 vertically so as to adjust the spacing between photoconductive surface 12 and screen member 28. Preferably, screen member 28 is an arcuate member having a curvature equal to the curvature of drum 10. In addition, the centers of curvature of screen member 28 and drum 10 are coincident with one another. The radius of curvature of screen member 28 is greater than the radius of curvature of drum 10, the difference defining the spacing therebetween. The spacing between photoconductive surface 12 and screen member 28 may be adjusted. This regulates the contrast of the resultant copy. Thus, in the pictorial mode of operation, contrast may be adjusted by regulating the spacing between screen member 28 and photoconductive surface 12. This may be achieved by slidably mounting screen member 28 on rails. A rack and pinion assembly may be employed to move screen member 28 along the foregoing rails. This is achieved by energizing drive system 74, which, in this mode of operation, rotates the pinion, thereby translating the rack and moving screen member 28 along the rails. This adjusts the spacing between screen member 28 and photoconductive surface 12.

In the functional mode of operation, drive system 74 moves screen member 28 out of the optical path so that the light image is not modulated. Alternatively, drive system 74 may move screen member 28 to a position spaced an optimum distance from photoconductive surface 12 for high contrast copying. Thus, in the functional mode, an unmodulated single color light image irradiates charged photoconductive surface 12 producing a single color electrostatic latent image. Successive single color electrostatic latent images are recorded on photoconductive surface 12 and developed in the manner heretofore described. The resultant toner powder images are transferred to the sheet of support material mounted on the transfer roll. These toner powder images are then permanently affixed to the sheet of support material creating a functional copy of the original document. It is, therefore, apparent that the major distinction between the functional copying mode and the pictorial copying mode is the location of the screen. In the pictorial copy mode the screen member modulates the light image producing a pictorial copy. Contrawise, in the functional copying mode the screen member is removed from the optical light path or spaced an optimum distance from photoconductive surface 12 to produce high contrast copies, and the light image is unmodulated resulting in a functional copy. Mode selection is an operator function. By this, it is meant that the operator by depressing a button marked functional or pictorial, selects the mode of operation. If the operator selects the functional mode of operation drive system 74 is energized to translate screen member 28 away from the optical light path, or, in lieu thereof, to an optimum distance from photoconductive surface 12. The translation of screen member 28 is achieved by a solenoid having an arm secured thereto. Energization of the solenoid removes screen member 28 from the optical light path. Contrawise, depression of the pictorial mode button de-energizes the solenoid of the drive system and moves screen member 28 into the optical light path. In addition to the foregoing controls, a contrast control is mounted in the printing machine. The contrast control permits the operator to actuate drive system 74 so as to regulate the spacing between screen member 28 and photoconductive surface 12. This, in turn, adjusts the contrast of the pictorial copy reproduced thereby, or moves the screen to an optimum position for functional copying.

Figure 3:
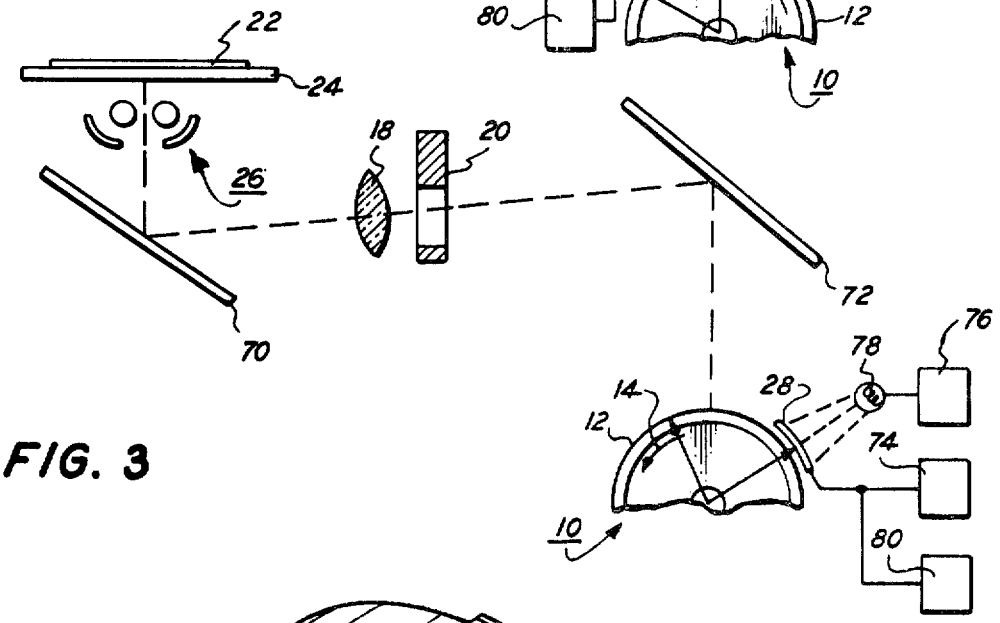
FIG. 3 is an elevational view of another embodiment of the exposure system employed in the FIG. 1 printing machine.

Turning now to FIG. 3, there is shown still another embodiment of the printing machine. As shown in FIG. 3, a screen member 28 is positioned at exposure station B prior to the path of the light image. It should be noted that in this mode of operation, the screen member may be located either prior to or subsequent to the light image optical path. Once again, lamps 26 move across platen 24 scanning original document 22. The light rays reflected from original document 22 are, in turn, reflected by mirror 70 through lens 18 forming a flowing light image. The flowing light image passes through the corresponding filter of filter mechanism 20 producing a single color flowing light image. This single color flowing light is reflected in a downwardly direction by mirror 72 onto photoconductive surface 12. The flowing light image irradiates the portion of photoconductive surface 12 having the screen pattern thereon. In the event that the screen is located after the formation of the flowing light image, the screen light pattern will be projected into superimposed registration with the latent image of the original document recorded on photoconductive surface 12. The screen pattern is formed by screen member 28 having light rays from light source or lamps 78 passing therethrough and irradiates photoconductive surface 12 prior to or subsequent to the formation of the original document and latent image. The intensity of illumination emitted from lamp 78 is adjustable by varying the power level of the voltage source 76 exciting lamp 78.

The spacing, between the screen member 28 and photoconductive surface 12, may be adjusted by drive system 74 as heretofore described. Briefly, a screen member 28 is mounted on rails and drive system 74 in conjunction with rack and pin assembly regulates the spacing between photoconductive surface 12 and screen member 28. This, in turn, adjusts the contrast of the resultant copy. Light source 78 projects light rays through screen member 28 forming a screen pattern on photoconductive surface 12. This screen pattern moves in the direction of arrow 14 and has the flowing light image of the original document projected thereon in superimposed registration therewith. Thus, the resultant composite electrostatic latent image formed on photoconductive surface 12 is modulated. This is a sequential optical exposure rather than the multiplicative optical exposure as is shown in FIG. 3. In the pictorial mode of operation, screen member 28 and light source 78 are operational. Lamp 78 is excited by voltage source 76. In order to place the printing machine in the functional mode of operation, voltage source 76 is de-energized, thereby de-energizing lamp 78. In this manner, light rays are not projected through screen member 28 and a screen pattern is not formed on photoconductive surface 12. Thus, the single color flowing light image irradiates the charged portions of the photoconductive surface producing a single color electrostatic latent image which is unmodulated. Hence, in the functional mode the latent image is unmodulated, whereas in the pictorial mode the latent image is modulated. Modulation is achieved by the formation of a screen pattern on the photoconductive surface in superimposed registration with a latent image of the original document. Thereafter the modulated latent image is rendered visible by the development process heretofore described.

Figure 4:
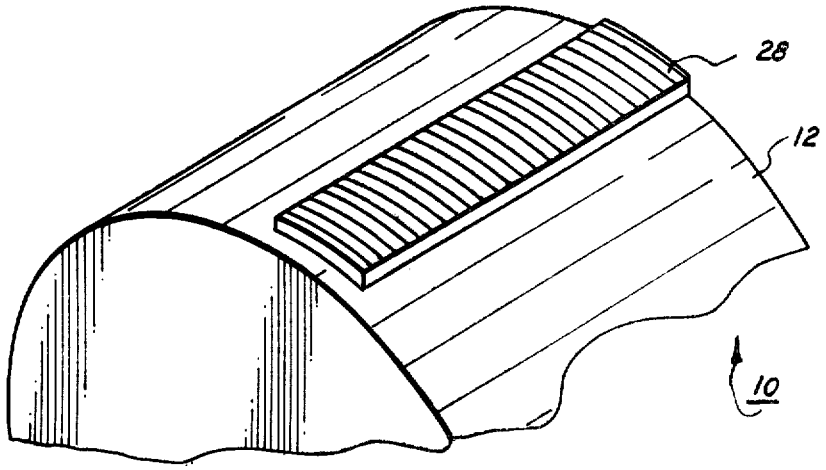
FIG. 4 is a schematic perspective view depicting the relationship of the screen member and photoconductive member employed in the FIG. 1 printing machine.

Referring now to FIG. 4, there is shown a detailed description of screen member 28 and its association with drum 10. As shown in FIG. 4, screen member 28 includes a plurality of substantially equally spaced opaque lines. During the pictorial mode of operation, screen member 28 may be shifted a distance equal to one third of the spacing between adjacent lines. This shift occurs between the formation of successive single color images. By way of example, screen member 28 may be located in its normal position when the green light image is projected therethrough. However, when the next light image, such as the red light images projected therethrough, screen member 28 is shifted one-third of a period, i.e. one-third of the distance between the spacing of adjacent opaque lines thereon. This shift does not change the spacing between screen member 28 and photoconductive surface 12. This shift prevents the occurrence of Moire patterns and improves color saturation. The shifting between successive single color light images in the pictorial mode is achieved automatically by a vernier system. This is a precise control system which moves screen member 28 incrementally independently from drive system 74. As heretofore indicated, drive system 74 includes a solenoid adapted to move screen member 28 away from the optical light path in the embodiment depicted in FIG. 2. However, independent thereof, screen member 28 is shifted incrementally one-third of the spacing between adjacent lines. This shift occurs between the formation of successive single color light images preventing the formation of Moire patterns.

Motor 80 in conjunction with a suitable linkage such as a parallel bar mechanism or a precision rack and pinion system moves screen member 28. Screen member 28 is moved a distance equal to one-third of the spacing between adjacent lines. Actuation of shifting mechanism 80 is achieved by the timing system in the printing machine and the logic associated therewith. Thus, when the timing disc indicates that the first single color light images is no longer being projected through screen member 28, motor 80 is energized moving screen member 28 a distance equal to one-third of the space between adjacent lines and the next successive single color light image is projected therethrough. In the event that screen member 28 is not in the optical light path, (FIG. 3) the foregoing occurs in the same manner. The screen pattern formed on photoconductive surface 12 is shifted one-third of the distance between adjacent lines. The lateral shift of screen member 28 also improves color saturation.

Screen member 28 may be formed on a transluscent layer or substrate which adheres to a transparent portion or substrate. The transparent portion may be preferably from a suitable flexible transparent plastic sheet such as Mylar. Screen member 28 may include a plurality of lines printed on a substantially transparent substrate by a suitable chemical etching technique, or by a photographic technique. The screen itself may be made from any number of opaque metallic material suitable for chemical etching such as copper or aluminum. As heretofore indicated, the transparent portion is made preferably from a suitable plastic material. A finer screen size generally results in a more natural or higher quality copy. Hence, while a coarse screen having 50 to 60 lines per linear inch will be useful for some purposes, finer screens such as those having anywhere from 100 to 400 or more lines per inch will give a more nearly continuous toner appearance to the finished copy. With finer screens, the screen pattern may be barely perceptible on the finished copy and a copy will have the appearance of a continuous tone photograph.

In recapitulation, it is evident that the electrophotographic printing machine heretofore described operates in one of two mode, i.e. a pictorial mode or a functional mode. In the pictorial mode, a screen is utilized to modulate the electrostatic latent image of the original document.

Contrawise, in the functional mode the electrostatic latent image remains unmodulated. In operation, the screen may be moved into or out of the optical light path as the mode of operation is changed from the pictorial mode to the functional mode. When an additive system is employed, the light source for generating light rays which pass through the screen member may be deenergized so as to decouple the screen member from the printing machine system. Contrast is readily adjustable by regulating the spacing between the screen member and photoconductive surface. Moire patterns are minimized and color saturation improved by shifting the screen member a distance equal to one-third of the spacing between adjacent lines on the screen. This shift occurs between successive single color light images. In this manner, high quality pictorial copies and functional copies may be produced.

It is, therefore, apparent that there has been provided in accordance with the present invention, an electrophotographic printing machine that operates in the pictorial or functional mode. This printing machine fully satisfies the objects, aims, and advantages hereinbefore set forth. While the present invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. An electrostatographic printing machine for reproducing an original document; including:

a photoconductive member;

a screen member comprising a plurality of substantially equally spaced lines;

means for charging said photoconductive member to a substantially uniform potential;

means for projecting a light image of the original document through said screen member onto said photoconductive member discharging selectively the charge recording a modulated electrostatic latent image thereon, said projecting means comprises means for filtering successive light images with differently colored filters so as to record successive modulated single color electrostatic latent images on said photoconductive member;

means for developing the modulated latent image recorded on said photoconductive member with charged particles; said developing means renders each single color latent image visible with charged particles of a color complementary to the color of the corresponding single color light image;

means for transferring the charged particles from said photoconductive member to a copy sheet in image configuration, said transferring means transfers successive differently colored charged particles to the copy sheet in superimposed registration with one another;

means for permanently affixing the charged particles to the copy sheet, said fixing means permanently affixes the differently colored charged particles to the copy sheet forming a colored copy of the original document;

means for moving said screen member into the light image path to produce a pictorial copy and for moving said screen member out of the light image path to produce a functional copy; and means for shifting said screen member one-third of the spacing between adjacent lines thereon for each successive single color light image being formed.

2. A printing machine as recited in claim 1, further including a light source for projecting light rays through said screen member.

3. An electrostatographic printing machine for reproducing an original document; including:

a photoconductive member;

means for charging said photoconductive member to a substantially uniform potential;

a screen member comprising a plurality of substantially equally spaced lines;

a light source in communication with said screen member for directing light rays through said screen member onto said photoconductive member for recording a screen pattern thereon;

means for projecting a light image of the original document onto said photoconductive member recording an electrostatic latent image thereon, the latent image and the screen pattern being in superimposed registration with one another on said photoconductive member recording a modulated electrostatic latent image thereon, said projecting means includes means for filtering successive light images with differently colored filters so as to record successive single color latent images on said photoconductive member;

means for developing the modulated latent image recorded on said photoconductive member with charged particles, said developing means renders each single color latent image visible with charged particles of a color complementary to the color of the corresponding single color light image;

means for transferring the charged particles from said photoconductive member to a copy sheet in image configuration, said transferring means transfers successive differently colored charged particles to the copy sheet in superimposed registration with one another;

means for permanently affixing the charged particles to the copy sheet, said fixing means permanently affixes the differently colored charged particles to the copy sheet forming a colored copy of the original document;

means for energizing said light source to produce a pictorial copy and for de-energizing said light source to produce a functional copy; and means for shifting said screen member one-third of the spacing between adjacent lines thereon for each successive single color light image being formed.

4. A printing machine as recited in claim 3, further including means for adjusting the spacing between said photoconductive member and said screen member.

5. An electrophotographic printing machine of the type having an arcuate photoconductive member, including:

a screen member mounted movably in the printing machine closely spaced to the photoconductive member, said screen member comprises an arcuate member having a curvature equal to the curvature of said arcuate photoconductive member with the centers of curvature being in coincidence with one another and the radius of curvature of said screen member being greater than the radius of curvature of said photoconductive member;

means for adjusting the spacing between the photoconductive member and said screen member; and means for translating said screen member relative to said photoconductive member while maintaining the spacing between said screen member and photoconductive member substantially constant.

6. A printing machine as recited in claim 5, wherein said screen member includes a plurality of substantially equally spaced lines.

7. A printing machine as recited in claim 6, further including:

means for charging the photoconductive member to a substantially uniform potential; and means for projecting a light image of the original document through said screen member onto said photoconductive member discharging selectively the charge recording a modulated electrostatic latent image thereon.

8. A printing machine as recited in claim 7, wherein said projecting means includes means for filtering successive light images with differently colored filters so as to record successive modulated single colored latent images on said photoconductive member.

9. A printing machine as recited in claim 8, further including means for shifting said screen member one-third of the spacing between adjacent lines thereon for each successive single color light image being formed.

10. A printing machine as recited in claim 9, further including:

means for developing each single color latent image with charged particles complementary in color to the color of the corresponding single color light image;

means for transferring successive differently colored charged particles to the copy sheet in superimposed registration with one another; and means for permanently affixing the differently colored charged particles to the copy sheet forming a colored copy of the original document

11. A printing machine as recited in claim 10, further including a light source in communication with said screen member for directing light rays through said screen member onto the photoconductive member.

* * * * *